US008122810B2

(12) United States Patent
Glasson

(10) Patent No.: US 8,122,810 B2
(45) Date of Patent: Feb. 28, 2012

(54) ROCKET PROPELLED BARRIER DEFENSE SYSTEM

(75) Inventor: Richard O. Glasson, Whippany, NJ (US)

(73) Assignee: CPI IP, LLC, East Hanover, NJ (US)

( * ) Notice: Subject to any disclaimer, the term of this patent is extended or adjusted under 35 U.S.C. 154(b) by 420 days.

(21) Appl. No.: 12/082,237

(22) Filed: Apr. 9, 2008

(65) Prior Publication Data

US 2011/0252953 A1 Oct. 20, 2011

Related U.S. Application Data

(63) Continuation of application No. 11/030,649, filed on Jan. 6, 2005, now abandoned.

(51) Int. Cl.
*B64D 1/04* (2006.01)

(52) U.S. Cl. ..... 89/1.11; 89/36.01; 89/36.11; 89/36.04; 89/36.16; 244/1 TD; 244/1 R; 102/336; 102/348; 102/402

(58) Field of Classification Search ..... 89/1.11, 89/36.01, 36.11, 36.04, 36.16; 102/336, 102/348, 402; 244/1 TD, 1 R
See application file for complete search history.

(56) References Cited

U.S. PATENT DOCUMENTS

| | | | | | |
|---|---|---|---|---|---|
| 2,251,918 | A | * | 8/1941 | Dawson | 102/504 |
| 2,876,678 | A | | 3/1959 | Lyon | |
| 3,173,334 | A | | 3/1965 | Landstorm | |
| 3,228,295 | A | | 1/1966 | Kane | |
| 3,245,317 | A | | 4/1966 | Matson | |
| 3,249,011 | A | | 5/1966 | Wermager | |
| 3,263,565 | A | | 8/1966 | Dragonetti | |
| 3,412,640 | A | | 11/1968 | Nash | |
| 3,568,191 | A | * | 3/1971 | Hiester et al. | 342/8 |
| 4,040,334 | A | | 8/1977 | Smethers, Jr. | |
| 4,149,166 | A | * | 4/1979 | Null | 342/13 |
| 4,208,949 | A | | 6/1980 | Boilsen | |
| 4,231,311 | A | * | 11/1980 | Longerich | 114/244 |
| 4,333,384 | A | | 6/1982 | Arnold | |
| 4,409,880 | A | | 10/1983 | Fetterly | |
| 4,475,436 | A | | 10/1984 | Campbell | |
| 4,768,417 | A | * | 9/1988 | Wright | 89/1.11 |
| 5,069,109 | A | * | 12/1991 | Lavan, Jr. | 89/1.11 |
| 5,187,318 | A | | 2/1993 | Sanderson | |
| 5,333,814 | A | * | 8/1994 | Wallis | 244/1 TD |
| RE34,873 | E | * | 3/1995 | Luttrell | 273/360 |
| 5,417,139 | A | * | 5/1995 | Boggs et al. | 89/1.11 |
| 5,583,311 | A | * | 12/1996 | Rieger | 89/1.11 |
| 5,675,104 | A | * | 10/1997 | Schorr et al. | 89/1.13 |
| 5,710,423 | A | * | 1/1998 | Biven et al. | 244/3.1 |
| 5,988,036 | A | * | 11/1999 | Mangolds et al. | 86/1.1 |
| 6,325,015 | B1 | * | 12/2001 | Garcia et al. | 114/382 |
| 6,394,016 | B2 | * | 5/2002 | Swartout et al. | 114/254 |
| 6,626,077 | B1 | * | 9/2003 | Gilbert | 89/1.11 |
| 6,904,838 | B1 | * | 6/2005 | Dindl | 89/1.1 |
| 6,957,602 | B1 | * | 10/2005 | Koenig et al. | 89/1.11 |
| 6,980,151 | B1 | | 12/2005 | Mohan | |
| 7,046,187 | B2 | | 5/2006 | Fullerton et al. | |
| 7,066,427 | B2 | * | 6/2006 | Chang | 244/3.19 |

(Continued)

OTHER PUBLICATIONS

Office Action mailed on Jul. 18, 2011 in related U.S. Appl. No. 12/187,842.

*Primary Examiner* — Michelle Clement

(57) ABSTRACT

A system providing a physical-barrier defense against rocket-propelled grenades (RPGs). The system is suitable for use on aircraft, ground vehicles, and ships.

12 Claims, 4 Drawing Sheets

U.S. PATENT DOCUMENTS 7,190,304 B1 3/2007 Carlson
7,202,809 B1 4/2007 Schade et al.
7,328,644 B2 * 2/2008 Vickroy ..... 89/1.11
7,412,916 B2 * 8/2008 Lloyd ..... 89/1.11
7,786,417 B2 * 8/2010 Sells, II ..... 244/3.1
2010/0243799 A1 * 9/2010 Al-Qaffas ..... 244/110 C

* cited by examiner

ROCKET PROPELLED BARRIER DEFENSE SYSTEM

CROSS REFERENCE TO RELATED APPLICATIONS

This application is a Continuation of application Ser. No. 11/030,649, filed on Jan. 6, 2005 now abandoned, which is incorporated herein by reference.

BACKGROUND OF THE INVENTION

Recent conflicts around the world highlight the combat effectiveness of RPGs. The RPG is often the key "force multiplier" for terrorist or extremist hostile forces. Helicopter downings by RPGs have become an increasingly deadly factor in recent major conflicts. Multiple incidents in Somalia, Afghanistan, and Iraq have involved significant loss of life. Such incidents provide encouragement and disproportionate stature to hostile forces. Additionally, missiles and RPGs pose an emerging threat to passenger and cargo aviation as well as to ground transports.

SUMMARY OF THE INVENTION

The present invention describes an expendable Rocket-Towed Barrier (RTB) system designed to prevent RPGs from reaching their targets. The system is comprised of:

Vehicular-mounted launch pod(s)

Multiple RTB expendable countermeasures

The system utilizes existing technologies for the identification and targeting of threats. The system takes advantage of the fact that RPGs and personnel-fired missiles are, in terms of combat projectiles, relatively slow-moving and there is a short time available to identify threats and launch countermeasures. Each RTB launch pod provides a zone of coverage. The actual RTB projectile does not need to precisely intercept the incoming munition. Furthermore, the launch of several RTB projectiles in a pattern toward the path of the incoming threat will provide a very high likelihood of interception. Unlike other proposals, such as explosive ball bearing grenades, this system presents an effective counter to lethal munitions while maintaining a low probability of collateral damage to non-combatants in the launch vicinity.

BRIEF DESCRIPTION OF THE DRAWINGS

The present invention is described with reference to the following figures, in which.

DETAILED DESCRIPTION OF THE INVENTION

Figure 1:
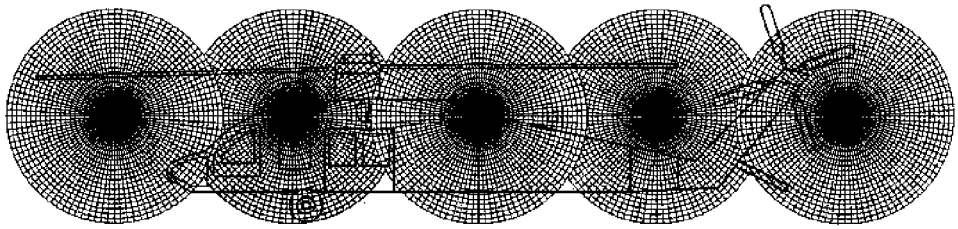
FIG. 1 shows the area of coverage provided by several rocket-towed barriers, superimposed upon the outline of a helicopter.
Figure 2:
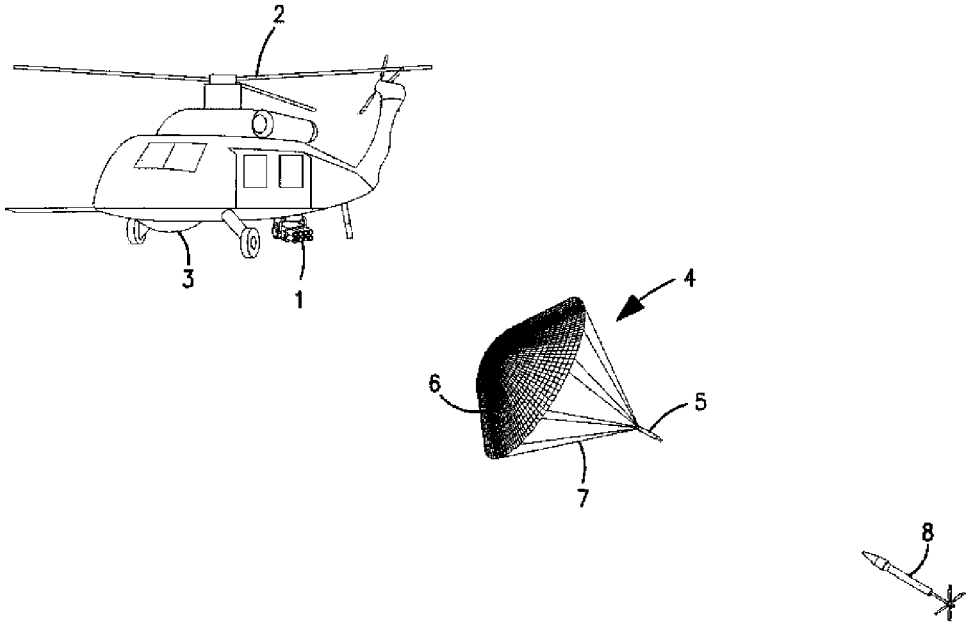
FIG. 2 shows a rocket-towed barrier on an intercepting course between a helicopter and a threat missile.

In one embodiment, referring to FIG. 2, the launch pod is a simple weatherproof cluster of thermoplastic tubes. Launch pods 1 are attached to the host vehicle 2 in such a way that the launch tubes are directed toward the zone from which RPG protection is desired. The system interfaces with a threat identification system 3, such as the BAE Systems ALQ-156 pulse-Doppler radar system, or the ALQ-212 IR warning system, both of which are now in widespread use. Threat direction and time-to-go data are used to determine the optimum firing time for the RTB countermeasures. In this respect, the system is almost identical to current chaff or IR decoy countermeasure systems, with the distinction that the present system is designed to physically intercept the threat munition, thereby providing a significantly greater degree of security. Additionally, IR and chaff decoy systems provide no defense against RPGs, which are essentially ballistic projectiles having no in-flight seek or guidance capabilities. In another embodiment, the countermeasure-firing pod is actively aimed using rapid-acting electromechanical or fluid powered actuators similar to systems in current use such as the Raytheon Phalanx Close In Weapon System (CIWS). Data from the radar system is used to point the countermeasure launch tube(s) on an approximate intercepting trajectory, taking account of velocities of the threat, the countermeasure, and the host vehicle. The present system would be smaller and simpler than current CIWS systems primarily because the rate of fire is much lower and the projectiles are self-propelled, requiring only a launch tube. An additional simplifying factor is that precise threat intercept (hitting a bullet with a bullet) is not a requirement of the present system. In yet a more complex embodiment, the RTB countermeasure may employ active guidance. This system would offer tracking and in-flight course correction. Assuming active guidance combined with accurate data on the flight path of the threat, it may be possible to deliver the threat munition back to its point of origin.

Expendable Countermeasure

Referring to FIG. 2, the expendable RTB 4 utilizes a quick firing, single-stage solid-fueled rocket 5. The RTB rocket 5 is similar in most respects to a hobby rocket, with necessary enhancements for sizing, flight stability, and mission reliability. The RTB rocket tows a mesh barrier 6 that, after launch, is inflated by aerodynamic forces. The inflated barrier provides a wide radius of coverage for intercept of incoming threats along the RTB flight path.

Towed Barrier

In one embodiment, the towed barrier 4 is in the shape of a small, flat drogue parachute. The drogue-shaped barrier is aerodynamically symmetric, resembling an aircraft-braking parachute, but is constructed of a mesh material that presents a physical barrier to oncoming munitions, while allowing most oncoming air to pass through. The mesh material may be Kevlar fiber, stainless steel braided cable, or a combination of materials. The mesh is optimized for strength and aerodynamic drag characteristics. The drogue tethers 7 are fixed to the tow rocket fuselage in such a way as to provide uniform pull force when the drogue is inflated. The tethers 7 are constructed to withstand the initial shock of encountering an RPG 8. The tether system may employ an elastic element to partially dissipate the kinetic energy of a captured or diverted RPG. The drogue exploits aerodynamic forces to maintain maximum frontal area with respect to the RTB flight path. The drogue/rocket package is optimized for threat interdiction. The drogue is intentionally designed to slow the RTB rocket to the optimum velocity for maximum time-in-the-path of incoming threats. Mesh barriers of other shapes are operable with this system. In a further embodiment, a mesh barrier of rectangular frontal aspect is deployed. Larger barriers may employ multiple tow rockets in order to maintain the desired cross-section during threat interdiction.

Stowage

Figure 3A:
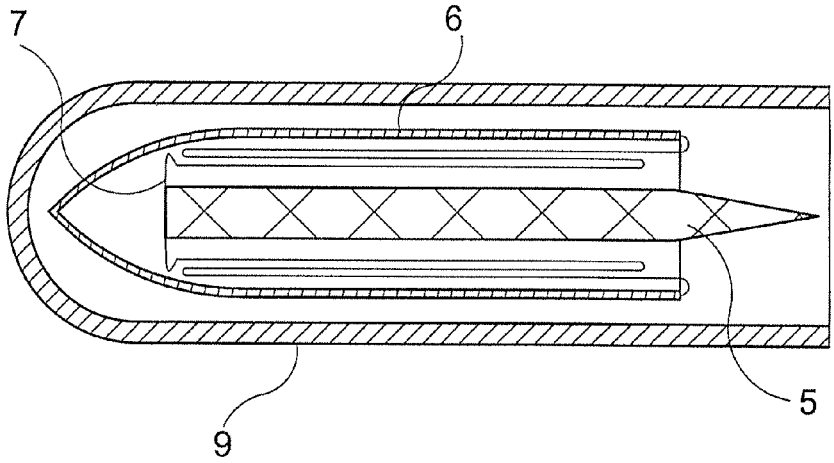
FIGS. 3A-3C show the launch sequence of a single rocket-towed barrier.

Referring to the cross-sectional diagram illustrated by FIG. 3A, in one embodiment the towed barrier 6 is packed with the RTB rocket 5 and the barrier tethers 7 in launch tube 9. The barrier is folded and wrapped into a compact package that is formed around the rocket. At launch and as illustrated in the partial cross-sectional diagram of FIG. 3B, the rocket 5 first leaves the launch tube 9 pulling the barrier tethers 7 along behind it. Applicant points out that FIGS. 3A and 3B are schematic diagrams in which certain dimensional relationships have been exaggerated (for example, the clearances between an outer surface of the RTB rocket 5, the drogue 6 and an inner surface of the launch tube 9) in order to provide clarity as to the relative positioning among elements illustrated in FIGS. 3A and 3B.

Figure 3B:
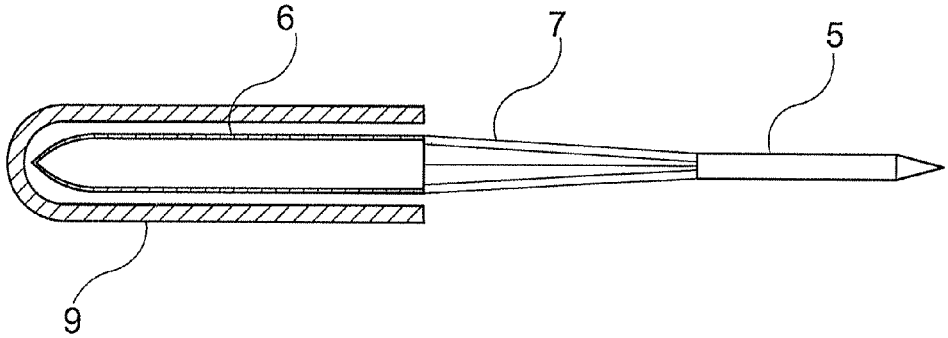
Figure 3C:
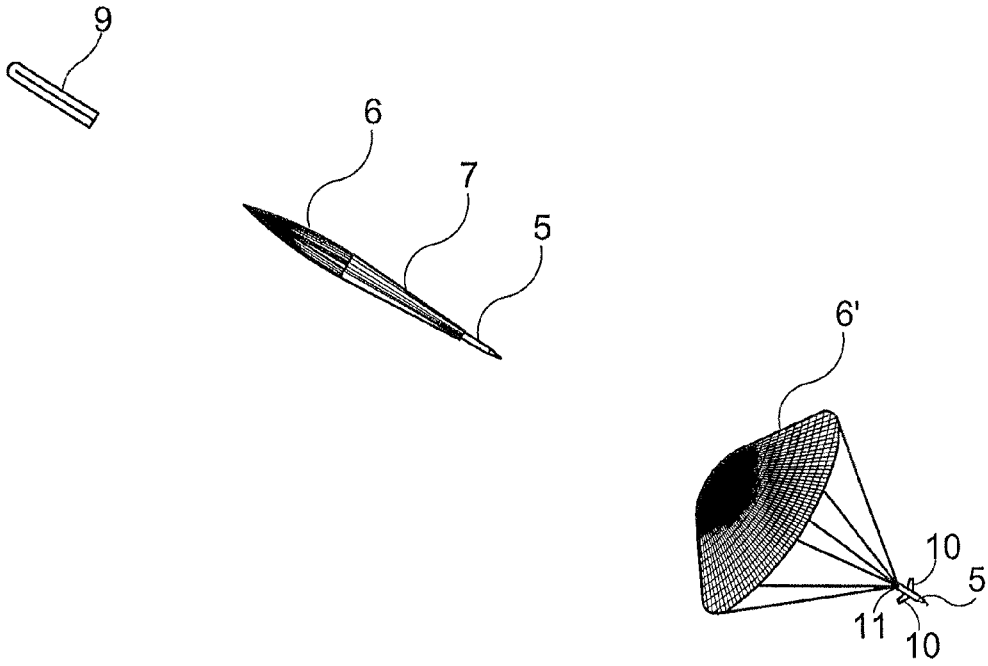

As illustrated in FIGS. 3B and 3C, the tethers 7 in turn pull the drogue 6 out of its folded state and out of the launch tube 9. As the drogue 6 clears the launch tube 9 and proceeds along the flight path, aerodynamic forces cause it to inflate to its maximum diameter as illustrated by element 6' of FIG. 3C. Certain areas of the towed barrier 6' may be subject to high heat from the tow rocket 5. In particular, the area directly behind the tow rocket 5 may be subject to high heat. Since the countermeasure is expendable, and the flight duration is on the order of a few seconds, this would not seriously degrade the effectiveness of the system. In RTB systems with more demanding mission requirements, the towed barrier 6, 6' may be fitted with a heat protective coating in the area of the rocket exhaust. The drogue/rocket package 5, 6, 7 may be stored as a unit in its own expendable launch tube 9. Such a system would facilitate quick and easy replacement of discharged countermeasures, much as is the case with current chaff dispensing systems. In another embodiment of the present invention, the complete launch tube units 5, 6, 7, 9 may be incorporated into a magazine, or may be provided in an ammunition belt configuration.

Guidance

Rocket stabilization and guidance may take one of several forms depending on the system complexity as described above. Referring to FIG. 3, in one embodiment fixed aspect aerodynamic fins 10 are used to stabilize the RTB rocket on its flight path. The fins may extend via spring pressure after ejection from the launch tube. Another embodiment provides inertial stabilization through the use of a spinning mass. A tubular section of the rocket fuselage spins around the axis of flight. The spin motion may be imparted via an ablative multi-vane impeller that is coupled to the rotating section and situated along the rocket axis. A portion of the rocket exhaust drives the impeller. Active guidance via moveable control surfaces may also be employed. Active guidance methods are established in the art, and are not an object of the present invention.

Additional Defensive Capabilities

The RTB rocket may carry flare or other IR countermeasures, thus doubling as a decoy for heat-seeking threats and attracting those threats into the effective radius of the RTB countermeasure.

Explosive Interdiction

The RTB may additionally be equipped with an explosive destruct charge 11 that destroys or disables threat munitions that are in the vicinity of the RTB. The destruct charge triggers when force on drogue tethers exceeds a predetermined value. The destruct charge combines with the physical barrier to provide enhanced capabilities to the RTB system. Explosive RTBs may be effective against threats that could defeat the drogue netting alone (such as SAMs and personnel fired missiles). In-flight arming of the destruct charge safeguards the host vehicle from accidental detonation and from detonation during the initial shock of the inflation of the towed barrier. In one embodiment, a MEMS G sensor integrates flight time away from host to provide a safe arming distance. Hall-effect sensors and spring-mounted magnet provide non-contacting force trigger. The towed barrier tethers are connected to the spring-mounted magnet. After arming, the appropriate force on the tethers brings the magnet sufficiently close to the hall-effect sensors to trigger an electrical impulse to the destruct charge. Additional destruct charge fusing methods could be employed including heat sensing, proximity, or time-delay methods.

What is claimed is:

1. An interception system comprising:

a detection system;

a launch system; and a rocket-towed barrier for intercepting a projectile, the rocket-towed barrier including:

a rocket, a launch tube a barrier element, and a tether system affixed to the barrier and to a fuselage of the rocket, wherein the detection system detects the presence of a projectile and generates an instruction in response to the detection, wherein the launch system launches the rocket-towed barrier along a trajectory in response to the instruction, wherein, before launch, the barrier element is folded and wrapped around the rocket, and the rocket, the barrier element and the tether system are positioned within the launch tube, wherein, at launch, the rocket exits the launch tube and pulls the tether system out of the launch tube, and the tether system pulls the barrier element out of the launch tube, and wherein the barrier element of the rocket-towed barrier after exiting the launch tube unfolds in an area directly behind the rocket and inflates to a maximum diameter in response to an aerodynamic force applied to the barrier element along the trajectory of the rocket.

2. The system of claim 1, wherein the rocket-towed barrier is configured for intercepting a rocket propelled grenade.

3. The system of claim 1, wherein the launch system includes a plurality of launch tubes.

4. The system of claim 3, wherein each of the plurality of launch tubes provides a zone of coverage for defense against the projectile.

5. The system of claim 1, wherein the rocket-towed barrier is actively guided.

6. The system of claim 1, wherein the barrier portion is a mesh material.

7. The system of claim 1, wherein the barrier portion is in the shape of a drogue parachute.

8. The system of claim 1, wherein the rocket portion contains a plurality of fixed aspect aerodynamic fins.

9. The system of claim 1, wherein the system further includes an explosive destruct charge.

10. The system of claim 1, wherein the tether system further comprises an elastic element.

11. The system of claim 1, wherein the rocket-towed barrier further comprises a destruct charge.

12. The system of claim 1, wherein the rocket comprises a plurality of fins each configured to movably extend outwardly away from a tubular section of the rocket after the rocket exits the launch tube via spring pressure.

* * * * *